United States Patent [19]

Hoegl et al.

[11] 4,069,046

[45] Jan. 17, 1978

[54] POLYMERIZED VINYL CARBAZOLES SENSITIZED BY NITRO-SUBSTITUTED 9-DICYANOMETHYLENE FLUORENES

[75] Inventors: Helmut Hoegl, Grand-Lancy, Geneva; Giacomo Barchietto, Cointrin, Geneva, both of Switzerland

[73] Assignee: Xerox Corporation, Stamford, Conn.

[21] Appl. No.: 437,573

[22] Filed: Jan. 29, 1974

Related U.S. Application Data

[63] Continuation of Ser. No. 116,989, Feb. 19, 1971, abandoned, which is a continuation-in-part of Ser. No. 652,278, July 10, 1967, abandoned.

[51] Int. Cl.[2] ..... G03Q 5/06; G03Q 13/22

[52] U.S. Cl. ..... 96/1 PC; 96/1.5 R

[58] Field of Search ..... 96/1.5, 1.6

[56] References Cited

U.S. PATENT DOCUMENTS

| | | | |
|---|---|---|---|
| 3,159,483 | 12/1967 | Behmenberg et al. | 96/1.5 |
| 3,232,755 | 1/1966 | Hoegl et al. | 96/1.5 |
| 3,257,207 | 6/1966 | Schleisinger et al. | 96/1.5 |
| 3,287,119 | 11/1966 | Hoegl | 96/1.5 |
| 3,408,190 | 10/1968 | Mammino | 96/1.5 |

*Primary Examiner*—Roland E. Martin, Jr.
*Attorney, Agent, or Firm*—James J. Ralabate; James P. O'Sullivan; John H. Faro

[57] ABSTRACT

An electrophotographic plate is described comprising a charge-transfer complex of an aromatic resin and certain Lewis acids; typically 9-dicyanomethylene-2,4,7-trinitro-fluorene. Also described are methods of preparing and using this plate.

22 Claims, 4 Drawing Figures

Figure 1:
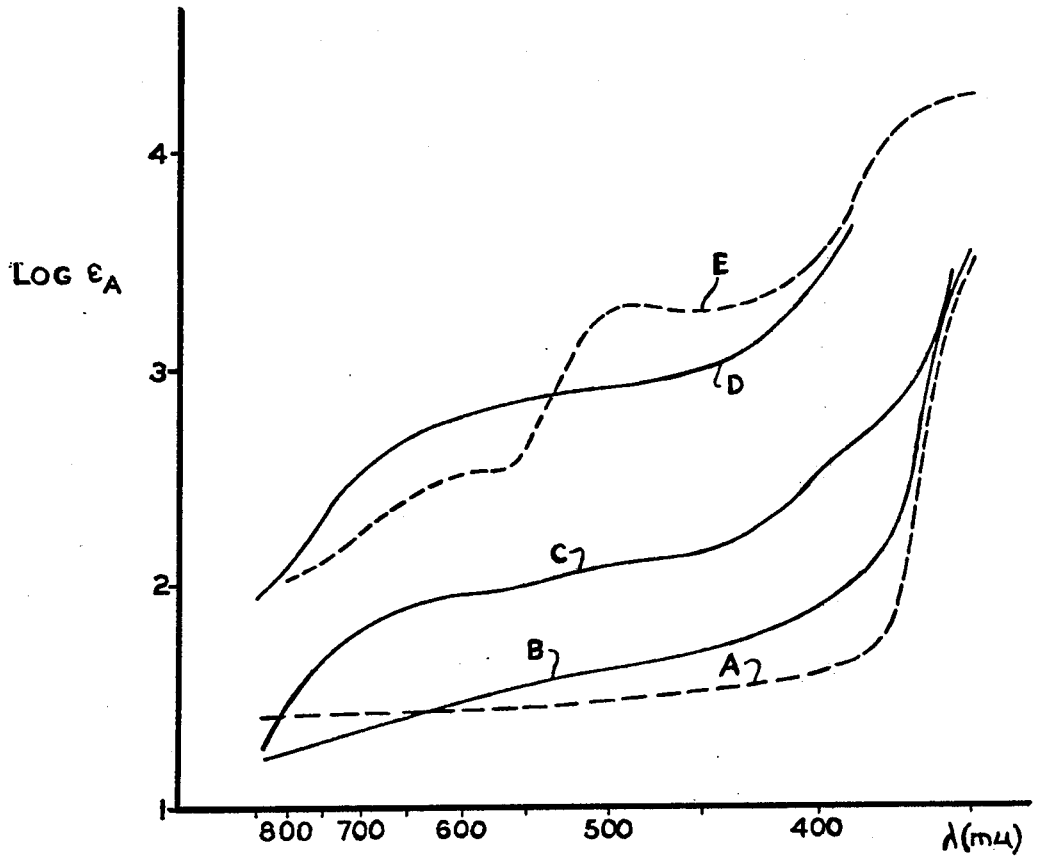

POLYMERIZED VINYL CARBAZOLES SENSITIZED BY NITRO-SUBSTITUTED 9-DICYANOMETHYLENE FLUORENES

CROSS-REFERENCE TO RELATED APPLICATIONS

This application is a continuation of application Ser. No. 116,989, filed Feb. 19, 1971, now abandoned, which in turn was a continuation-in-part of application Ser. No. 652,278, filed July 10, 1967 (also abandoned).

BACKGROUND OF THE INVENTION

This invention relates to photoconductive materials, and more particularly, to their use in electrophotography.

It is known that images may be formed and developed on the surface of certain photoconductive materials by electrostatic means. The basic xerographic process, as taught by Carlson in U.S. Pat. No. 2,297,691, involves uniformly charging a photoconductive insulating layer and then exposing the layer to a light-and-shadow image which dissipates the charge on the areas of the layer which are exposed to light. The electrostatic latent image formed on the layer corresponds to the configuration of the light-and-shadow image. This image is rendered visible by depositing on the image layer a finely divided developing material comprising an electroscopic marking material called a toner. The powder developing material will normally be attracted to those portions of the layer which retain a charge, thereby forming a powder image corresponding to the latent electrostatic image. This powder image may be transferred to paper or other receiving surface. The paper then will bear the powder image which may subsequently be made permanent by heating or other suitable fixing means. The above general process is also described in U.S. Pat. Nos. 2,357,809; 2,891,011 and 3,079,342.

That various photoconductive insulating materials may be used in making electrophotographic plates is known. Suitable photoconductive insulating materials such as anthracene, sulfur, selenium or mixtures thereof, have been disclosed by Carlson in U.S. Pat. No. 2,297,691. These materials generally have sensitivity in the blue or near ultra-violet range, and all but selenium have a further limitation of being only slightly light sensitive. For this reason, selenium has been the most commercially accepted material for use in electrophotographic plates. Vitreous selenium however, while desirable in most aspects, suffers from some limitations in that its spectral response is somewhat limited to the ultraviolet, blue and green regions of the spectrum and the preparation of vitreous selenium plates requires costly and complex procedures, such as vacuum evaporation. Also, selenium plates require the use of a separate conductive substrate layer, preferably with an additional barrier layer deposited thereon before description of the selenium photoconductor. Because of these economic and commercial considerations, there have been many recent efforts towards developing photoconductive insulating materials other than selenium for use in electrophotographic plates.

It has been proposed that various two-component materials be used in photoconductive insulating layers used in electrophotographic plates. For example, the use of inorganic photoconductive pigments dispersed in suitable binder materials to form photoconductive insulating layers is known. It has further been demonstrated that organic photoconductive dyes and a wide variety of polycyclic compounds may be used together with suitable resin materials to form photoconductive insulating layers useful in binder-type plates. In each of these two systems, it is necessary that at least one original component used to prepare the photoconductive insulating layer be, itself, a photoconductive material.

In a third type plate, inherently photoconductive polymers are used; frequently in combination with sensitizing dyes or Lewis acids to form photoconductive insulating layers. Again, in these plates at least one photoconductive component is necessary in the formation of the layer. While the concept of sensitizing photoconductors is, itself, commercially useful, it does have the drawback of being limited to only those materials already having substantial photoconductivity.

The above discussed three types of known plates are further described in U.S. Pat. Nos. 3,097,095; 3,113,022; 3,041,165; 3,126,281; 3,073,861; 3,072,479; 2,999,750; Canadian Patent No. 644,167 and German Patent No. 1,068,115.

The polymeric and binder-type organic photoconductor plates of the prior art generally have the inherent disadvantages of high cost of manufacture, brittleness, and poor adhesion to supporting substrates. A number of these photoconductive insulating layers have low temperature distortion properties which make them undesirable in an automatic electrophotographic apparatus which often includes powerful lamps and thermal fusing devices which tend to heat the xerographic plate. Also, the choice of physical properties has been limited by the necessity of using only inherently photoconductive materials.

Inorganic pigment-binder plates are limited in usefulness because thay are often opaque and are thus limited to use in systems where light transmission is not required. Inorganic pigment-binder plates have the further disadvantage of being non-reusable due to high fatigue and rough surfaces which make cleaning difficult. Stil another disadvantage is that the materials used have been limited to those having inherent photoconductive insulating properties.

It has recently been discovered that certain aromatic polymers having slight photoconductivity may be sensitized by suitable Lewis acids to produce photoconductive insulating layers having good physical properties and satisfactory sensitivity for many electrophotographic applications. Typical polymers which may be sensitized are: poly-N-vinyl carbazole, aromatic phenolic resins as described in U.S. Pat. Nos. 3,408,183; 3,408,186; 3,408,188; 3,408,190 and others. These resins may be sensitized with any of a number of non-photoconductive Lewis acids to produce useful electrophotographic plates. While these plates are useful for many purposes, they tend to have low sensitivity with most Lewis acids and often have a color cast characteristic of the Lewis acid or of the complex formed by the Lewis acid and the aromatic resin. Where an image is to be developed directly on the photoconductive layer and the imaged sheet is to be used as a transparency for projection, the color cast is objectionable. Also, many of these plates have low image resolution characteristics, presumably due to objectionably high lateral conductivity. Thus, there is a continuing need for improved Lewis acids to produce electrophotographic plates with the aromatic resins which are known to form charge transfer complexes.

SUMMARY OF THE INVENTION

It is, therefore, an object of this invention to provide a photoconductive insulating material suitable for use in electrophotographic plates devoid of the above-noted disadvantages.

Another object of this invention is to provide an economical method for the preparation of photoconductive insulating materials wherein none of the required components is by itself substantially photoconductive.

Another object of this invention is to provide a photoconductive insulating material suitable for use in electrophotograhic plates in both single use and reusable systems.

Another object of this invention is to provide charge-transfer complex photoconductive materials having higher sensitivity.

Another object of this invention is to provide charge-transfer complex photoconductive materials capable of producing high resolution images.

Another object of this invention is to provide charge-transfer complex photoconductive materials which are substantially transparent to slightly gray in color.

Another object of this invention is to provide improved non-photoconductive Lewis acids which form charge-transfer complexes with aromatic resins to form higher photoconductive materials.

Yet, still another object is to provide a photoconductive insulating layer for an electrophotographic plate which is substantially resistant to abrasion and has a relatively high distortion temperature.

Yet, a further object of this invention is to provide an electrophotographic plate having a wide range of useful physical properties.

A still further object of this invention is to provide photoconductive insulating layers which may be cast into self-supporting binder-free photoconductive films and structures.

Still another object of this invention is to provide a novel combination of materials suitable for use in the manufacture of the photoconductive insulating layer of a xerographic plate which are easily coated on a desired substrate or combined with a conductive layer.

Another object is to provide a transparent self-supporting photoconductive film adapted for xerographic imaging which does not require a conductive backing.

A still further object of this invention is to provide a photoconductive insulating material which may be made substantially transparent and which is particularly adapted for use in systems where light transmission is required.

The foregoing objects and others are accomplished in accordance with this invention, generally speaking, by providing a photoconductive material adapted for use in electrophotographic plates which is obtained by complexing:

a. an aromatic resin with b. a Lewis acid having the general formula:

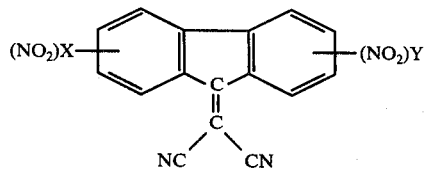

wherein each of X and Y is a positive integer from 0–2. The Lewis acid is considered a "dopant" for the aromatic polymer.

It should be noted that neither of the above two components, (A and B) used to make the photoconductor of this invention is by itself substantially photoconductive.

The Lewis acids characterized by the above general formula are 9-dicyanomethylene-fluorene and nitro substituted 9-dicyanomethylene-fluorene compounds. These compounds may be prepared by any conventional synthesis. Typically, they may be prepared by the method described by T. K. Mukherjie and L. A. Levasseur, J. Org. Chem. 30, 644 (1965). Of the compounds within the general formula given above, 9-dicyanomethylene-2,4,7-trinitro-fluorene has been found to give exceptionally high photosensitivity with very low concentrations of Lewis acid in the aromatic resin. This, then, is considered to be the optimum compound within this group.

Any suitable sensitizing proportions of Lewis acid to aromatic resin may be used. In general, from about 1 to about 200 parts resin per part Lewis acid may be used. For greatest economy together with highest photosensitivity, about 1 mole percent Lewis acid per 100 mole percent aromatic resin is preferred.

The Lewis acids coming within the general formula given above may be complexed with any suitable aromatic resin. Typical aromatic resins which form useful electrophotographic plates with these Lewis acids include poly-N-vinyl carbazole, styrene resins, phenol-aldehyde resins, polycarbonates, epoxy resins, phenoxy resins, polyurethanes, silicone resins, polysulfones, polyphenylene oxides, melamine resins, and copolymers or mixtures thereof. It will be understood, that when particular resins are referred to generically, that only those having an aromatic moiety are included. The aromatic portion may be carbocyclic or heterocyclic.

While poly-N-vinyl carbazole is though to be substantially non-photoconductive in the very pure state, in practice almost any film prepared from poly-N-vinyl carbazole will exhibit some photoconductivity due to the presence of very small amounts of electron-acceptors, e.g., oxygen absorbed from the air. Thus films formed from commercial poly-N-vinyl carbazole often exhibit measurable photoconductivity. Note U.S. Pat. No. 3,037,861 to Hoegl et al which describes the sensitization of poly-N-vinyl carbazole generally.

After the above substantially non-photoconductive Lewis acid is mixed or otherwise complexed with said substantially non-photoconductive resinous material, a highly desirable photoconductive insulating material is obtained which may be either cast as a self-supporting layer or may be deposited on a suitable supporting substrate. Any other suitable method of preparing a photoconductive plate from the above photoconductive material may be used.

A Lewis acid is any electron acceptor relative to other materials present in the system. A Lewis acid will tend to accept electrons furnished by an electron donor (or Lewis base) in the process of forming a chemical compound or, as in the present invention, a charge transfer complex.

A "Lewis acid" is defined for the purposes of this invention as any electron accepting material relative to the polymer to which it is complexed.

A "charge-transfer complex" may be defined as a molecular complex between substantially neutral electron donor and acceptor molecules, characterized by the fact that photoexcitation produces internal electron transfer to yield a temporary excited state in which the donor is more positive and the acceptor more negative than in the ground state.

It is believed that the insulating resins are rendered photoconductive by the formation of charge transfer complexes with electron acceptors or Lewis acids and that these complexes, once formed, constitute the photoconductive elements of the plates.

Broadly speaking, charge transfer complexes are loose associations containing electron donors and acceptors, frequently in stoichiometric ratios, which are characterized as follows:

A. Donor-acceptor interaction is weak in the neutral ground state, i.e., neither donor nor acceptor is appreciably perturbed by the other in the absence of photoexcitation.

B. Donor-acceptor interaction is relatively strong in the photo-excited state, i.e., the components are at least partially ionized by photoexcitation.

C. When the complex is formed, one or more new absorption bands appear in the near ultraviolet or visible region (wavelengths between 3,200 – 7,500 Angstrom Units) which are present in neither donor alone nor acceptor alone, but which are instead a property of the donor-acceptor complex.

Both the intrinsic absorption bands of the donor and the charge transfer bands of the complex may be used to excite photoconductivity.

"Photoconductive insulator" for the purposes of this invention is defined with reference to the practical application in electrophotographic imaging. It is generally considered that any insulator may be rendered "photoconductive" through excitation by sufficiently intense radiation of sufficiently short wavelengths. This statement applies generally to inorganic as well as to organic materials, including the inert binder resins used in binder plates, and the electron acceptor type activators and aromatic resins used in the present invention. However, the short wavelength radiation sensitivity is not useful in practical imaging systems because sufficiently intense sources of wavelengths below 3200 Angstrom Units are not available, because such radiation is damaging to the human eye and because this radiation is absorbed by glass optical systems. Accordingly, for the purposes of this application, the term "photoconductive insulator" includes only those materials which may be characterized as follows:

1. They may be formed into continuous films which are capable of retaining an electrostatic charge in the absence of actinic radiation.
2. These films are sufficiently sensitive to illumination of wavelengths longer than 3200 Angstrom Units to be discharged by at least one-half by a total flux of at most $10^{14}$ quanta/cm.$^2$ of absorbed radiation.

This definition excludes the pure resins and Lewis Acids of this invention when used individually from the class of "photoconductive insulators".

Figure 2:
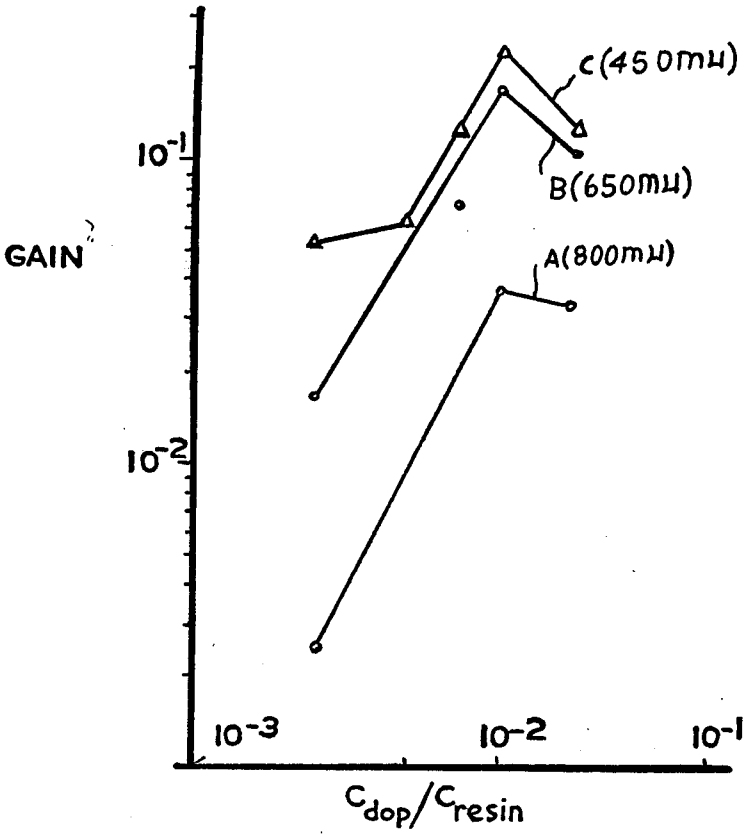
Figure 3:
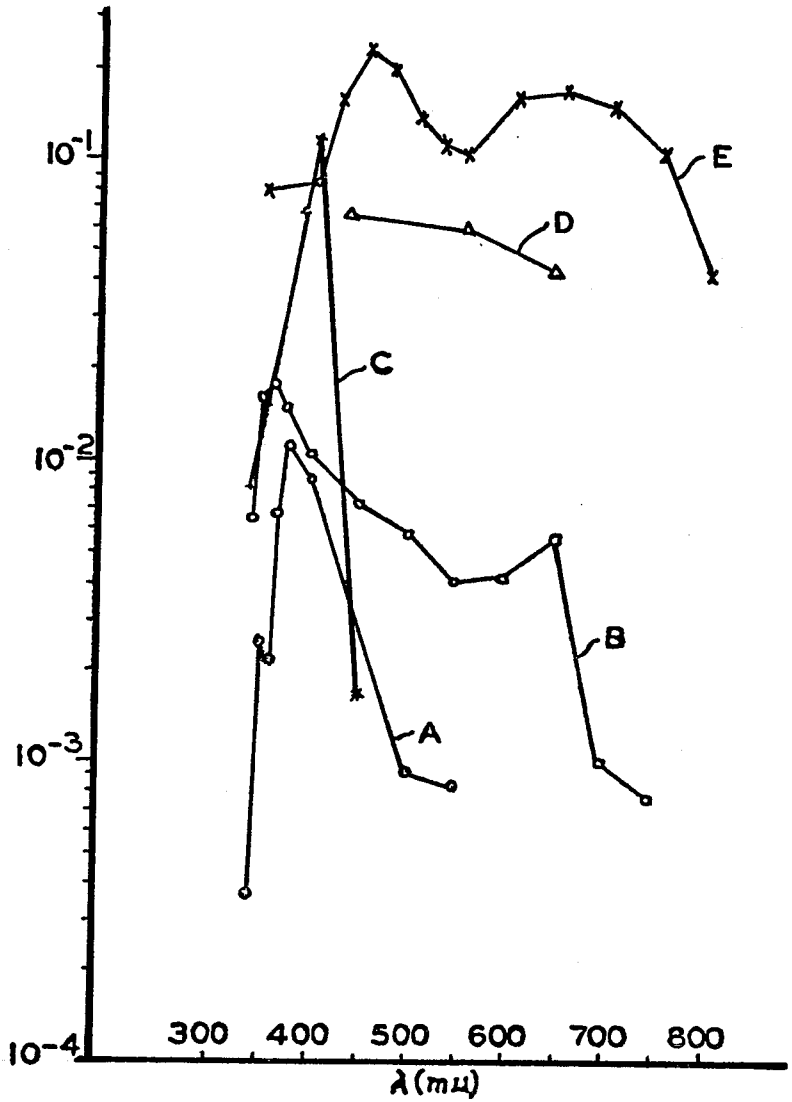
Figure 4:
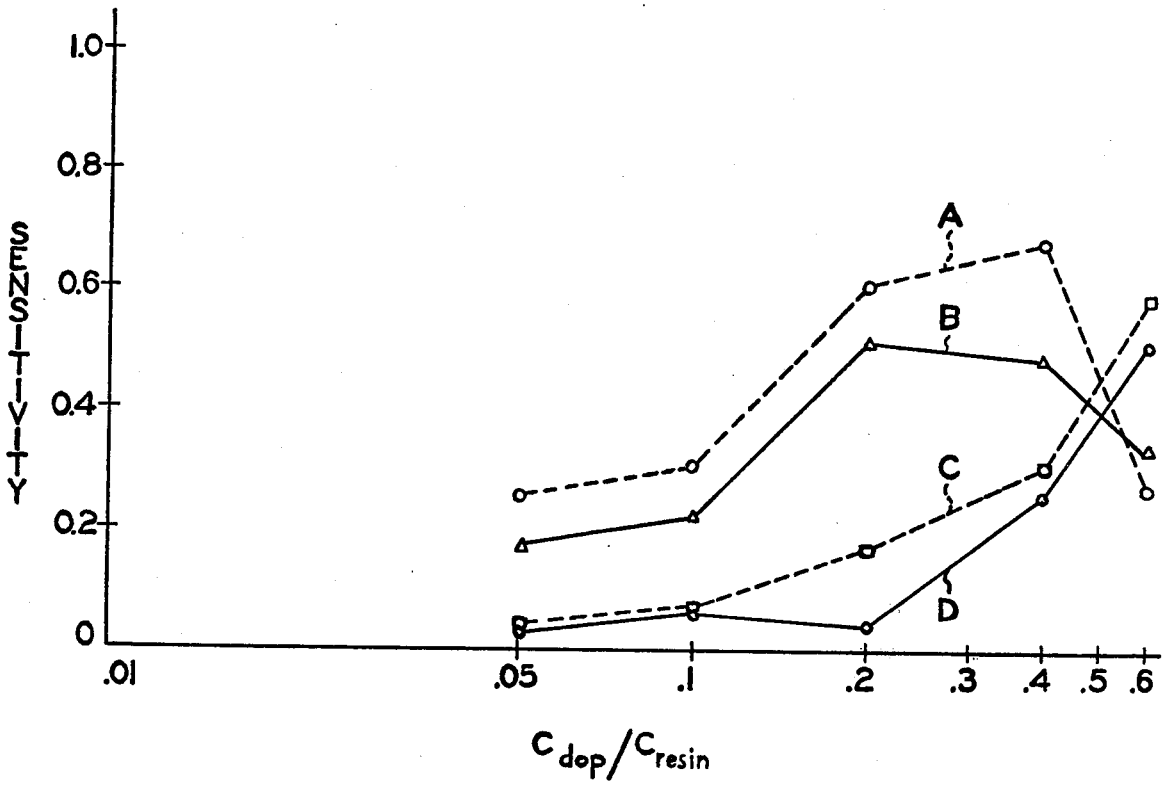

For a more complete understanding of the advantages of the present invention, reference is now made to the accompanying drawings in which:

FIG. 1 is a chart showing the improved spectral response of aromatic resins sensitized with varying proportions of the dopants of the present invention;

FIG. 2 is a chart showing variations in gain at different wavelengths for aromatic resins doped with varying amounts of the dopant of the present invention; and, FIG. 3 is a chart showing gain at various wavelengths for poly-N-vinyl carbazole sensitized with optimized amounts of a variety of charge-transfer complexing dopants; and FIG. 4 is a chart showing the sensitivity at 679 m $\mu$ for poly-N-vinyl carbazole sensitized with varying molar ratios of 9-dicyanomethylene-2,4,7-trinitrofluorene and for poly-N-vinyl carbazole sennsitized with corresponding molar ratios of 2,4,7-trinitro-9-fluorenone.

Referring now to FIG. 1, there is seen plots of light absorption (log $\epsilon_A$), the extinction coefficient for the film against light wavelengths. Curve A represents an undoped poly-N-vinyl carbazole plate while Curve E represents the dopant alone in solution. Curves B, C and D represent the absorption of poly-N-vinyl carbazole with different amounts of dopant. As can be seen from FIG. 1, there is a dramatic increase in light absorption across the visible spectrum with increasing amounts of dopant. There appears a very broad band around 470 m $\mu$, due to the dopant, and a new broad band estimated at 550 m $\mu$, not present in the component spectra, attributable to a charge-transfer complex. Details of the preparation and testing of the plates analyzed in FIG. 1 are given in Example I below.

Referring now to FIG. 2, these is seen a plot of photoconductive gain (a measure of photosensitivity) against concentration of dopant (in mole percent) and poly-N-vinyl carbazole. Details of the preparation of the plates, the curves for which are shown in FIG. 2 are given in Example II below. Curve A represents the gain obtained with various amounts of dopant with light having a wavelength of 800 m $\mu$. Similarly, Curves B and C show the gain for various concentrations of dopant at wavelengths of 650 m $\mu$ and 450 m $\mu$, respectively. As can be seen from FIG. 2, about 1 mole percent of the dopant, 9-dicyano-methylene-2,4,7-trinitro-fluorene, per 100 mole percent poly-N-vinyl carbazole gives the highest gain and, therefore, the greatest efficiency in electrophotographic imaging processes.

Referring now to FIG. 3, there is seen several curves representing the gain obtained when poly-N-vinyl carbazole is doped with optimum amounts of different charge-transfer complex sensitizers. The details of the preparation of the plates and the tests are given in Example III below. Curve A represents the gain for unsensitized polyvinyl carbazole. Curves B, C and D represent poly-N-vinyl carbazole sensitized with optimized amounts of three known charge-transfer complex sensitizers. The concentration of dopant in the poly-N-vinyl carbazole for Curves C, D and E is determined by the same procedure described in Example II for 9-dicyanomethylene-2,4,7-trinitro-fluorene. Curve E represents the gain for poly-N-vinyl carbazole sensitized with 1 mole percent 9-dicyanomethylene-2,4,7-trinitrofluorene. As can be seen from FIG. 3, gain with the dopants of this invention is surprisingly higher than that produced with other charge-transfer complex sensitizers. Although the optical absorption of poly-N-vinyl carbazole doped with 9-dicyanomethylene-2,4,7-trinitro-fluorene in the visible region is rather low (about 3 percent of the incident light at 800 m $\mu$ for 1 percent dopant) it is quite surprising that in spite of this gain is rather high (about 0.04).

Referring now to FIG. 4 there is shown a semilogarithmic plot of curves representing the sensitivity (a measure of photosensitivity) obtained using light having a wavelength of 697 m $\mu$ when poly-N-vinyl carbazole is doped with varying amounts of two different sensitizers. Curves A and B represent the sensitivities of compositions containing varying molar ratios of 9-dicyanomethylene-2,4,7-trinitrofluorene and N-vinyl carbazole monomeric units of poly-N-vinyl carbazole for charging with negative and positive polarities respectively. Curves C and D represent the sensitivities of compositions containing corresponding molar ratios of 2,4,7-trinitro-9-fluorenone and N-vinyl carbazole monomeric units of poly-N-vinyl carbazole for charging with negative and positive polarities respectively. The molar ratios are expressed in terms of moles of dopant per moles of N-vinyl carbazole monomeric units of poly-N-vinyl carbazole. As can be seen from FIG. 4 the sensitivity of the poly-N-vinyl carbazole doped with up to a molar concentration of about 0.4 (75% by weight) of 9-dicyanomethylene-2,4,7-trinitrofluorene is much higher. Above a molar concentration of about 0.4 of 9-dicyanomethylene-2,4,7-trinitrofluorene the compositions start to become highly crystalline. Details concerning the preparation and the testing of the plates analyzed in FIG. 4 are given in Example XII below.

The following examples will further define the present invention. Parts and percentages are by weight unless otherwise indicated. The examples below should be considered to illustrate various preferred embodiments of the present invention.

EXAMPLE I

A sample of poly-N-vinyl carbazole having an average molecular weight of about 63,000 is first prepared. A sample of monomeric N-vinyl carbazole is recrystallized from methanol until the melting point of about 65° C. is reached. The monomer is thermally polymerized at about 130° C. without catalyst for about 9½ hours. The reaction product is precipitated from toluene solution with methanol with further purification from benzene/methanol at about 40° C. The polymer product is a white powder having a melting point of about 220°-260° C.

The dopant, 9-dicyanomethylene-2,4,7-trinitro-fluroene is prepared according to the above noted method of Mukherjie and Levasseur. The material is recrystallized twice from acetonitrile and once from a 50% acetone-50% methanol mixture. This material is in the form of yellow crystals with a melting point of about 266° C.

A 6% solution by weight of the above prepared poly-N-vinyl carbazole is prepared in a solution consisting of 50% toluene and 50% tetrahydrofuran. The desired amount of the dopant is dissolved in this solution for each of the experiments described below. In each case the solution is coated onto a silica glass slide (available from Societe Electrothermique de la Tour de Treme, Fribourge, Switzerland) to a dry thickness of about 5.5 microns. Four plates are prepared, plate A being coated with undoped poly-N-vinyl carbazole, plate B coated with a solution of about 0.1 mole percent of the above dopant in poly-N-vinyl carbazole, plate C having about 1 mole percent of the above dopant in poly-N-vinyl carbazole and plate D having about 10 mole percent of the above dopant in poly-N-vinyl carbazole. The optical absorption spectra for these plates are measured using a Beckman DK-1 recording spectrometer (Beckman Instruments, Fullerton, California). Monochromatic light was produced from a Bausch & Lomb grating monochromator.

The results of the optical absorption measurements are plotted in FIG. 1 wherein the characteristics of each of the plates is indicated by a curve marked with the appropriate letter. Curve E is included for comparison and represents the optical absorption characteristics for the above dopant in an acetone solution. As can be seen from FIG. 1, the charge transfer sensitized films exhibit progressively increasing intensity and broadening of absorption with increasing concentration of dopant.

EXAMPLE II

Several NESA glass plates are coated as described in Example I from solution of a dopant, 9-dicyanomethylene-2,4,7-trinitro-fluorene in a poly-N-vinyl carbazole matrix. Gain is measured for films having different concentrations of dopant using monochromatic light of different wavelengths. The results are plotted in FIG. 2.

The effective quantum yield or gain (G) with respect to the number of charge carriers transported through the layers is defined as follows:

$$G = \frac{\text{number of elementary charges transported}}{\text{number of photons absorbed}}$$

or $$G = \frac{n_e}{n_{ph}}$$

$n_e$ is obtained from the decay of the surface potential ($\Delta$ V) by $$-n_e \cdot e = \Delta Q = C \times \Delta V$$

and $n_{ph}$ (of frequency V) from $$n_{ph} = \frac{I_L a A \Delta t}{h V}$$

with $0 \leqq A \leqq 1$, where C is capacitance and Q is charge density per unit area, $e = 1.6 \times 10^{-19}$ coulomb, $h = 6.62 \times 10^{-34}$ joule - sec (Planck's constant), A = fractional absorption of the photoconductive layer, $I_L$ = intensity of light in watts/cm², a = surface of sample in cm², and $\Delta t$ = illumination time (sec). With light velocity $c = \lambda \cdot V = 3 \times 10^{10}$ (cm/sec) and $\epsilon$ = dielectric constant of the polymers used (all having $\epsilon = 3.0$), $\epsilon_o = 8.85 \times 10^{-14}$ amp - sec/volt - cm, and the gain is $$G = \frac{h c \epsilon \epsilon^o}{e \lambda A I_L d} \frac{\Delta V}{\Delta t}$$

For each experiment, the light of the selected wavelength ($\lambda$) is produced by a Bausch & Lomb grating monochromator equipped with two interchangeable light sources (a super pressure mercury lamp for ultraviolet and a quartz iodine lamp for the visible range) and with two gratings. To eliminate higher order spectra, a Corning 0-52 filter is employed in the range of 400-575 nm. and a Corning 3-67 filter in the range of 575-800 nm. The initial field in each case is about $10^6$ volt/cm. Light intensity is measured with an Eppley Bi-Silver-spectrum thermopile (Eppley Laboratory, Newport, Rhode Island) and a Keithley electrometer Type 150A (Keithley Instruments, Inc., Cleveland, Ohio). Surface potential is measured with a Monroe Type 107AS electrometer (Monroe Electronic Laboratories, Middleport, New York).

Gain is calculated using wavelengths of 450, 650 and 800 mμ and a variety of Lewis acid concentrations. The results are plotted in FIG. 2.

As can be seen from FIG. 2, maximum gain is obtained where the poly-N-vinyl carbazole layer contains about 1 mole percent 9-dicyanomethylene-2,4,7-trinitro-fluorene.

EXAMPLE III

Gain obtained in poly-N-vinyl carbazole sensitized with various dopants including that of this invention is measured and plotted in FIG. 3. The concentrations chosen for each dopant were those where the highest gain values were observed in tests conducted with each Lewis acid as described in Example II above.

The samples for testing were prepared as follows:

Plate A consists of undoped poly-N-vinyl carbazole prepared as in Example I above.

Plate B consists of poly-N-vinyl carbazole with about 0.1 mole percent Nile Blue A (a dye obtained from Siegfried AG, Zofingen, Switzerland) which has the general formula:

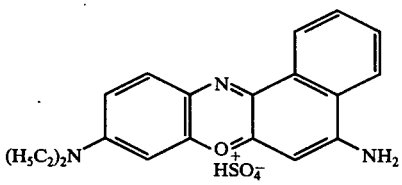

Plate C consists of poly-N-vinyl carbazole with about 0.1 mole percent 2,5-bis-(5'-butyl-benzoxalil-2')-thiophene) available from CIBA, Ltd, Basle, Switzerland; a colorless material having a melting point of about 201° C.

Plate D consists of poly-N-vinyl carbazole with about 10 mole percent 2,4,7-trinitro-9-fluorene, available from Fluka AG, Buchs, Switzerland.

Plate E consists of poly-N-vinyl carbazole with about 1 mole percent 9-dicyanomethylene-2,4,7-trinitro-fluorene prepared as described in Example I above.

Gain for the light of a variety of different wavelengths is measured for each of these samples as described above. As indicated in FIG. 3, gain for the samples sensitized according to the teachings of this invention (plate E) is much higher than that for pure poly-N-vinyl carbazole or for poly-N-vinyl carbazole sensitized with the other known charge transfer complexing agents. Although the optical absorption of poly-N-vinyl carbazole sensitized with 9-dicyanomethylene-2,4,7-trinitro-fluorene in the visible region is rather low (about 3% of the incident light at 800 nm. for 1% dopant) it is quite surprising that in spite of this the gain is rather high (about 0.04).

EXAMPLE IV

About 50 parts of a diphenyl oxide modified Novolak resin No. ET-395-1300 (available from the Dow Chemical Company) is dissolved in a solvent mixture consisting of about 250 parts acetone and about 200 parts toluene. The mixture is agitated by means of a stirrer until the resin is fully dissolved in the solvent. About 0.25 parts of 9-dicyanomethylene-2,4,7-trinitro-fluorene is added to the solution and the mixture is stirred until complete solution is obtained. This solution is coated onto an aluminum plate by means of a wire-wound bar and the coating is dried. The dried layer has a thickness of about 5 microns. The plate is negatively charged by means of a corona discharge unit held at about 600 volts as described in U.S. Pat. No. 2,588,699. The charged plate is then exposed for about 15 seconds by projection using a Simmons Omega D-3 Enlarger equipped with an F/4.5 lens. A conventional black-and-white transparency is used. The enlarger lamp operates at a color temperature of about 2950° K. The illumination level at the exposure plane is about 4 foot-candles as measured with a Weston Illumination Meter Model No. 756. The plate is then developed by cascading solid electroscopic developer particles across the plate by the process described in U.S. Pat. No. 2,618,551. The image developed on the plate is of good quality and corresponds to the projected image. The developed image is then electrostatically transferred to a paper receiving sheet as described in U.S. Pat. No. 2,576,047 and fused thereon. The plate is then cleaned of residual toner and is reused as by the above described process.

EXAMPLE V

About 30 parts of Bakelite phenoxy resin PKDA-8500 available from the Union Carbide Corporation, which is obtained from the reaction of bisphenol-A and eipchlorohydrin and has the following molecular structure:

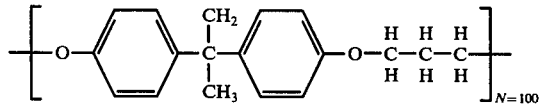

is put into a Pryex beaker containing a solvent blend consisting of about 80 parts ethyl cellosolve, about 90 parts methyl ethyl ketone and about 30 parts toluene. The mixture is agitated by means of a stirrer until all of the resin is in solution.

About 0.1 part 9-dicyanomethylene-2,4,7-trinitro-fluorene is dissolved in a solvent blend consisting of about 3 parts cyclohexanone and about 3 parts toluene. This solution is added to about 10 parts of the phenoxy resin solution prepared above. The mixture is agitated to insure complete mixing.

The above prepared solution is then applied onto an aluminum sheet (bright finished 1145-H 19 aluminum foil made by the Aluminum Company of America) by means of a wire-wound bar. The coating is dried to a dry thickness of about 5 microns.

The above prepared plate is negatively charged to about 450 volts by means of a corona discharge device. The charged plate is then exposed for about 15 seconds by projection to a black-and-white transparency using the enlarger described in Example IV above. The illumination level at the plate is about 4 foot-candles. The latent electrostatic image thus formed is developed by cascading electroscopic marking particles across the plate. The developed image is then electrostatically transferred to a paper receiving sheet and fused thereon. The image on the sheet is of good quality and corresponds to the projected image. The plate is then cleaned of residual toner and is reused by the above described process.

EXAMPLE VI

About 14 parts of a SR-82 (a methyl phenyl silicone resin available from the General Electrical Company) solution consisting of about 60% solids in xylene is mixed with about 40 parts toluene and about 20 parts cyclohexanone. To this solution is added about 2 parts 9-dicyanomethylene-2,7-dinitro-fluorene. The solution is coated to a dry thickness of about 5 microns onto a 5 mil aluminum plate by flow coating. The coating is dried, then cured for about 30 minutes at 200° C.

This plate is negatively charged to about 250 volts by means of a corona discharge unit. The charged plate is then exposed for about 10 seconds by projection using the projector described in Example IV above. Total light exposure is about 300 foot-candle-seconds. The plate is then developed by cascading electroscoping marking particles across the plate. The powder image formed on the plate is of good quality and corresponds to the original. The plate is heated to the melting temperature of the developed powder and cooled resulting in an image fixed to the plate.

EXAMPLE VII

About 4 parts PPO PR-531, a polyphenylene oxide resin available from General Electric Company, having the general formula:

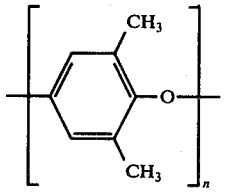

is dissolved in about 50 parts of dichlorobenzene. To this solution is added a solution consisting of about 1 part 9-dicyanomethylene-2,4,5,7-tetranitro-fluorene dissolved in a mixture of about 10 parts cyclohexanone and about 20 parts dichlorobenzene. The solution is coated to a thickness of about 7 microns onto a 5 mil aluminum plate by flow coating. The coating is dried, then cured for about 30 minutes at about 100° C.

This plate is negatively charged by means of a corona discharge unit held at about 600 volts. The charged plate is then exposed for about 10 seconds by projection using the projector described in Example IV above. Total light exposure is about 180 foot-candle-seconds. The plate is then cascade developed. Developed image is electrostatically transferred to a receiving sheet and fused thereon. The image on the receiving sheet corresponds to the original projected image.

EXAMPLE VIII

About 4 parts Cymel 301, a hexamethoxymethyl melamine resin available from American Cyanamide is dissolved in about 50 parts toluene. To this solution is added a solution consisting of about 1 part 9-dicyano-2,4,7-trinitro-fluorene dissolved in a mixture of about 4 parts cyclohexanone and about 20 parts toluene. The solution is coated to a dry thickness of about 5 microns onto a 5 mil aluminum plate by dip coating. The coating is dried for about 5 days at about 120° C.

This plate is uniformly electrostatically charged to a positive potential by means of a corona discharge unit held at about 600 volts. The charged plate is then exposed to an image for about 12 seconds by projection using the enlarger described in Example IV. Total light exposure is about 60 foot-candle-seconds. The plate is then developed with a liquid developer as described by Metcalfe in U.S. Pat. No. 2,907,674. The image formed on the plate corresponds to the original projected image.

EXAMPLE IX

A phenoxy resin is prepared by initially dispersing about 2 parts of polymethylene polyphenyl isocyanate (PAPI, available from the Corwin Chemical Company) in a solvent blend consisting of about 10 parts methyl ethyl ketone and about 20 parts cyclohexanone. About 1.5 parts bisphenol-A is added to the above prepared solution and the mixture is agitated by means of a stirrer until solution of the bisphenol-A is achieved. About 0.7 parts 9-dicyanomethylene-2,4,7-trinitro-fluorene is added to the above prepared solution and stirred as before to achieve solution.

The solution is applied onto a 5 mil aluminum sheet by dip coating and the coating is dried. The coating has a dry thickness of about 8 microns. The coating is cured for about 30 minutes at about 200° C.

The plate is negatively charged to about 400 volts by means of a corona discharge unit. The charged plate is then exposed by projection for about 12 seconds using the enlarger described in Example IV above. The illumination level at the exposure plane is about 4 foot-candles. The plate is then developed by cascade using electroscopic marking powder. The developed image is electrostatically transferred to a paper receiving sheet and fused thereon. The image on the receiving sheet corresponds to the original projected image.

EXAMPLE X

About 1 part of an aromatic epoxy resin, Epon 1031, available from the Shell Chemical Company, is dissolved in about 9 parts of a 1-2-1 solvent blend of acetone and toluene. The mixture is agitated with a stirrer until all the resin is fully dissolved in the solvent. About 0.5 parts of 9-dicyanomethylene-2,4,7-trinitro-fluorene is added to the epoxy resin solution prepared above and the mixture is stirred until solution is complete.

The above prepared solution is applied onto an aluminum substrate by means of a wire-wound bar and the coating is dried. The dried thickness of the coating is about 7 microns.

The plate is uniformly electrostatically charged to a negative potential by means of a corona discharge unit held at about 600 volts. The charged plate is then exposed to a black-and-white transparency by means of the enlarger described in Example IV for about 15 seconds. The resulting latent electrostatic image is developed by cascading electroscopic marking particles across the plate. The developed image is then electrostatically transferred to a paper receiving sheet and fused. An excellent image corresponding to the original projected image is observed on the receiving sheet.

EXAMPLE XI

About 1 part of a polyester of carboxylic acid and bis-(4-hydroxy phenyl)-2,2-propane (manufactured by the General Electric Company under the tradename Lexan Polycarbonate Resin, Grade 125, Color 111) is put into a beaker containing about 8 parts dichloromethane and 1 part of cyclohexanone. The mixture is agitated by means of a stirrer until the resin is fully dissolved. About 0.2 parts of 9-dicyanomethylene-2,4,7-trinitrofluorene is added to the polycarbonate resin solution prepared above.

The thus prepared solution is applied onto an aluminum substrate to a dry thickness of about 6 microns by means of a wire-wound bar.

The thus prepared plate is charged to a negative potential by means of a corona discharge device maintained at about 6,000 volts. The charged plate is exposed to a black-and-white transparency by means of the enlarger described in Example IV above. Total exposure is about 40 foot-candle-seconds. The latent electrostatic image formed on the plate is developed by cascading powdered electroscopic developing material over the plate. The developed image on the plate corresponds to the projected image.

EXAMPLE XII

A solution of 10 grams of poly-N-vinyl carbazole (obtained from Badische Anilin - und Sodafabrick A. G., Ludwigshafen 1 Rhein and identified as Luvican M170) in 70 grams of toluene and 20 grams of cyclohexanone is prepared. To this solution are added varying amounts of 9-dicyanomethylene-2,4,7-trinitrofluorene obtained from Eastman Organic Chemicals (Cat. No. 9724) having a molecular weight of 363.25 to form compositions which have 0.05, 0.1, 0.2, 0.4 and 0.6 molar ratios of 9-dicyanomethylene-2,4,7-trinitrofluorene and N-vinyl carbazole monomeric units of poly-N-vinyl carbazole. The procedure is repeated with 2,4,7-trinitro-9-fluorenone obtained from Eastman Organic Chemicals (Cat. No. 7135) having a molecular weight of 315.20 to form compositions having corresponding molar ratios of 2,4,7-trinitro-9-fluorenone and N-vinyl carbazle monomeric units of poly-N-vinyl carbazole.

Steel shot is added to each composition and they are then ball-milled for about eight to ten hours. Each composition is dipcoated onto a NESA glass plate (a layer of optically transparent glass overcoated with a thin optically transparent layer of tin oxide; (commercially available from Pittsburgh Plate Glass Co.) having an approximately 0.2 micron thick nylon layer on the tin oxide surface. The plates thus formed are then dried in an oven for about 1 hour at a temperature of approximately 80° C. The thicknesses of the photoconductive composition layers formed on the NESA glass are in the range of from about 1 micron to about 5.6 microns.

Each composition is then analyzed according to the following procedure: The photoconductive layer is corona charged by means of a corotron and then immediately moved under a DC loop probe which is attached to a Keithley electrometer the output from which is connected to a Brush recorder. The initial electric field applied to the compositions containing 9-dicyanomethylene-2,4,7-trinitrofluorene and 2,4,7-trinitro-9-fluorenone respectively is from 60 to 80 volts/micron and from 70 to 140 volts/micron respectively. The photoconductive composition is then exposed to monochromatic light with a wavelength of 697 mμ and an intensity of $5 \times 10^{13}$ PH/cm$^2$sec. The source is a General-Electric 200 watt tungsten-iodine lamp at a current of 6 amps with a 1.52 OD neutral density screen filter placed in front of the source.

The sensitivity of the composition is determined according to the formula:

$$S = (dv/dt)_{t=o}/Vo$$

where Vo is the potential at which the plate is initially charged prior to exposure to light and $(dv/dt)_{t=o}$ is the initial photodischarge and is measured as the slope of the discharge curve from the point at which the plate is exposed to light.

The results obtained are plotted in FIG. 4. As can be seen from FIG. 4, the compositions having up to about 0.4 molar concentrations of 9-dicyanomethylene-2,4,7-trinitrofluorene have much higher sensitivities for charging with both positive and negative polarities.

Although specific materials and conditions were set forth in the above examples, these were merely illustrative of the present invention. Various other compositions, such as the typical materials listed above and various conditions, wherein suitable, may be substituted for those given in the examples with similar results. The photoconductive composition of this invention may have other materials or colorants mixed therewith to enhance, sensitize, synergize or otherwise modify the photoconductive properties of the composition.

Many other modifications of the present invention will occur to those skilled in the art upon a reading of this disclosure. These are intended to be encompassed within the spirit of this invention and the scope of the claims.

What is claimed is:

1. A photoconductive composition comprising up to about 0.4 moles of a Lewis acid per monomeric unit of a polymerized vinyl carbazole compound, said Lewis acid having the general formula:

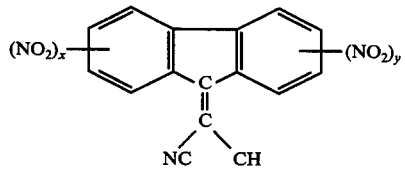

wherein each of X and Y is a positive integer from 0–2.

2. The composition as defined in claim 1, wherein said Lewis acid is 9-dicyanomethylene-2,4,7-trinitrofluorene.

3. The composition as defined in claim 1, wherein said polymerized vinyl carbazole compound is poly-N-vinyl carbazole.

4. The composition as defined in claim 1, wherein said Lewis acid is 9-dicyanomethylene-2,4,7-trinitrofluorene and said polymerized vinyl carbazole compound is poly-N-vinyl carbazole.

5. A process for forming an electrostatic latent charge pattern comprising uniformly electrostatically charging a photoconductive layer comprising a charge-transfer complex of up to about 0.4 moles of a Lewis acid per monomeric unit of a polymerized vinyl carbazole compound and exposing said layer to a pattern of activating electromagnetic radiation, said Lewis acid having the general formula:

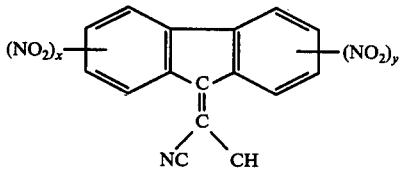

wherein each of X and Y is a positive integer from 0–2.

6. The process as defined in claim 5, wherein said Lewis acid is 9-dicyanomethylene-2,4,7-trinitrofluorene.

7. The process as defined in claim 5, wherein said polymerized vinyl carbazole compound is poly-N-vinyl carbazole.

8. The process as defined in claim 5, wherein said Lewis acid is 9-dicyanomethylene and said polymerized vinyl carbazole compound is poly-N-vinyl carbazole.

9. An electrostatic imaging process which comprises providing a photoconductive layer comprising a charge-transfer complex of up to about 0.4 moles of a Lewis acid per monomeric unit of a polymerized vinyl carbazole compound, forming an electrostatic latent image on said layer and developing said latent image with electroscopic marking material, said Lewis acid having the general formula:

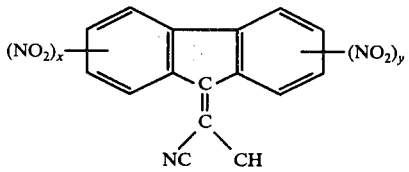

wherein each of X and Y is a positive integer from 0–2.

10. The process as defined in claim 9, wherein said Lewis acid is 9-dicyanomethylene-2,4,7-trinitrofluorene.

11. The process as defined in claim 9, wherein said polymerized vinyl carbazole compound is poly-N-vinyl carbazole.

12. The process as defined in claim 9, wherein said Lewis acid is 9-dicyanomethylene-2,4,7-trinitrofluorene and said polymerized vinyl carbazole compound is poly-N-vinyl carbazole.

13. A photoelectrostatic member comprising a conductive base support coated with a photoconductive film comprising a polymerized vinyl carbazole compound and a sensitizer having the formula

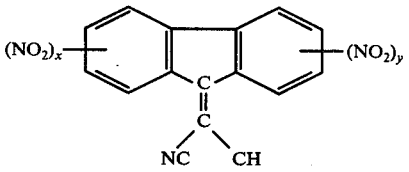

wherein each of $x$ and $y$ is a positive integer from 0–2.

14. A photoelectrostatic member as claimed in claim 13 in which the amount of sensitizer present is about 1 mole percent per 100 mole percent of said polymerized vinyl carbazole compound.

15. A photoelectrostatic member as claimed in claim 13 in which the polymerized vinyl carbazole compound is polyvinylcarbazole.

16. The photoelectrostatic member as claimed in claim 13, in which the sensitizer is 9-(dicyanomethylene)-2,4,7-trinitrofluorene.

17. The photoelectrostatic member as claimed in claim 13, in which the sensitizer is 9-(dicyanomethylene)-2,7-dinitrofluorene.

18. The photoelectrostatic member as claimed in in claim 13, in which the sensitizer is 9-(dicyanomethylene)-2,4,5,7-tetranitrofluorene.

19. The photoelectrostatic member as claimed in claim 13, in which the sensitizer is 9-(dicyanomethylene)-3-nitrofluorene.

20. The photoelectrostatic member as claimed in claim 13, in which the sensitizer is 9-(dicyanomethylene)fluorene.

21. A method of making a reproduction comprising the steps of applying a sensitizing charge to a photoelectric member having a conductive base support and a photoconductive medium of a polymerized vinyl carbazole compound sensitized with a compound having the formula

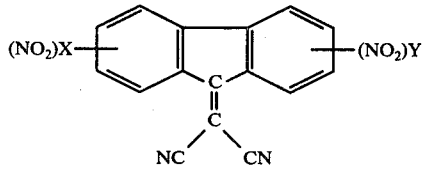

wherein each of X and Y is a positive integer from 0–2 exposing said charged member to a pattern of light and shadow comprising electromagnetic radiation in the visible range to produce a latent image thereon; and applying electroscopic powder to produce a material image corresponding to said pattern of light and shadow.

22. A photoelectrostatic member as defined in claim 13 wherein the sensitizer is present in an amount of one part per about 1 to about 200 parts polymerized vinyl carbazole compound.

* * * * *